US010586549B2

(12) United States Patent
Ragot et al.

(10) Patent No.: US 10,586,549 B2
(45) Date of Patent: Mar. 10, 2020

(54) DETERMINING A BUDGET FOR LPD/FD TRANSITION FRAME ENCODING

(71) Applicant: ORANGE, Paris (FR)

(72) Inventors: Stephane Ragot, Lannion (FR); Julien Faure, Ploubezre (FR)

(73) Assignee: ORANGE, Paris (FR)

( * ) Notice: Subject to any disclaimer, the term of this patent is extended or adjusted under 35 U.S.C. 154(b) by 125 days.

(21) Appl. No.: 15/329,671

(22) PCT Filed: Jul. 27, 2015

(86) PCT No.: PCT/FR2015/052073
§ 371 (c)(1),
(2) Date: Jan. 27, 2017

(87) PCT Pub. No.: WO2016/016566
PCT Pub. Date: Feb. 4, 2016

(65) Prior Publication Data

US 2018/0182408 A1 Jun. 28, 2018

(30) Foreign Application Priority Data

Jul. 29, 2014 (FR) ..... 14 57353

(51) Int. Cl.
*G10L 19/00* (2013.01)
*G10L 21/00* (2013.01)
(Continued)

(52) U.S. Cl.
CPC ..... *G10L 19/24* (2013.01); *G10L 19/002* (2013.01); *G10L 19/0212* (2013.01); *G10L 19/12* (2013.01)

(58) Field of Classification Search
CPC ..... G10L 19/12; G10L 19/002; G10L 19/20; G10L 19/04; G10L 19/025
(Continued)

(56) References Cited

U.S. PATENT DOCUMENTS 6,647,366 B2 * 11/2003 Wang ..... G10L 19/22 704/201
8,892,427 B2 * 11/2014 Oh ..... G10L 19/022 704/200.1
(Continued)

FOREIGN PATENT DOCUMENTS

WO 2012/085451 A1 6/2012
WO WO 2012085451 A1 * 6/2012 ..... G10L 19/022
WO 2016/016105 A1 2/2016

OTHER PUBLICATIONS

International Telecommunication Union, "Series G: Transmission Systems and Media, Digital Systems and Networks, Digital terminal equipments—Coding of analogue signals by methods other than PCM, Wideband coding of speech at around 16 kbit/s using Adaptive Multi-Rate Wideband (AMR-WB)," ITU-T Telecommunication Standardization Sector of ITU, ITU-T Recommendation G.722.2, Jan. 13, 2002, pp. 1-72.
(Continued)

*Primary Examiner* — Olujimi A Adesanya
(74) *Attorney, Agent, or Firm* — Drinker Biddle & Reath LLP

(57) ABSTRACT

A method of determining a distribution of bits for coding a transition frame, said method being implemented in a coder/decoder for coding/decoding a digital signal, the transition frame being preceded by a predictive coded preceding frame, coding the transition frame comprising transform coding and predictive coding a single sub-frame of the transition frame, the method comprising the following steps: assigning a bit rate for predictive coding the transition sub-frame, said bit rate being equal to the minimum between the bit rate for transform coding the transition frame and a first predetermined bit rate value; determining a first number of bits allocated for predictive coding the transition sub-frame for said bit rate; and calculating a second number of
(Continued)

bits allocated for transform coding the transition frame from the first number of bits and a number of bits available for coding the transition frame.

12 Claims, 7 Drawing Sheets

(51) Int. Cl.
*G10L 21/04* (2013.01)
*G10L 19/24* (2013.01)
*G10L 19/02* (2013.01)
*G10L 19/002* (2013.01)
*G10L 19/12* (2013.01)

(58) Field of Classification Search
USPC ..... 704/219, 500–504
See application file for complete search history.

(56) References Cited

U.S. PATENT DOCUMENTS 8,954,321 B1 * 2/2015 Beack ..... G10L 19/22 704/219
9,378,746 B2 * 6/2016 Choo ..... G10L 19/008
9,761,238 B2 * 9/2017 Choo ..... G10L 19/008
9,947,329 B2 * 4/2018 Helmrich ..... G10L 19/025
2007/0174053 A1 * 7/2007 You ..... G10L 19/008 704/222
2007/0219787 A1 * 9/2007 Manjunath ..... G10L 19/22 704/207
2009/0313009 A1 * 12/2009 Kovesi ..... G10L 19/24 704/203
2011/0320196 A1 * 12/2011 Choo ..... G10L 19/20 704/229
2012/0065980 A1 * 3/2012 Krishnan ..... G10L 19/025 704/262
2012/0245947 A1 * 9/2012 Neuendorf ..... G10L 19/20 704/500
2012/0271644 A1 * 10/2012 Bessette ..... G10L 19/03 704/500
2012/0323582 A1 * 12/2012 Peng ..... G10L 19/24 704/500
2013/0289981 A1 * 10/2013 Ragot ..... G10L 19/022 704/219
2013/0290003 A1 * 10/2013 Choo ..... G10L 19/008 704/500
2013/0332148 A1 * 12/2013 Ravelli ..... G10L 19/012 704/203
2014/0303965 A1 * 10/2014 Lee ..... G10L 19/002 704/201

OTHER PUBLICATIONS

Office Action issued in related application JP 2017-504670, dated Mar. 4, 2019, with English language translation, 8 pages.

* cited by examiner

DETERMINING A BUDGET FOR LPD/FD TRANSITION FRAME ENCODING

CROSS-REFERENCE TO RELATED APPLICATIONS

This application is the U.S. national phase of the International Patent Application No. PCT/FR2015/052073 filed Jul. 27, 2015, which claims the benefit of French Application No. 14 57353 filed Jul. 29, 2014, the entire content of which is incorporated herein by reference.

BACKGROUND

The present invention relates to the field of coding/decoding digital signals.

The invention advantageously applies to coding/decoding sounds which may contain speech and music, either mixed together or alternating.

In order to efficiently code the speech sounds at low rate, CELP type techniques ("Code Excited Linear Prediction") are recommended. In order to efficiently code the music sounds, transform coding techniques are recommended instead.

CELP type coders are predictive coders. Their objective is to model speech production from various elements: a short-term linear prediction to model the vocal tract, a long-term prediction to model the vocal cord vibration during a voiced period, and an excitation derived from a fixed dictionary (white noise, algebraic expectation) to represent the "innovation" which could not be modeled.

The transform coders such as MPEG AAC, AAC-LD, AAC-ELD, or ITU-T G.722.1 Annex C, for example, use critical sampling transforms in order to pack the signal in the transform domain. "Critical sampling transform" refers to a transform for which the number of coefficients in the transformed domain is equal to the number of time samples in each analyzed frame.

A solution for efficiently coding a signal with mixed speech/music content consists in selecting over time the best technique between at least two coding modes, one of CELP type, the other of transform type.

It is for example the case for 3GPP AMR-WB+ and MPEG USAC codecs (for "Unified Speech Audio Coding"). The applications aimed by AMR-WB+ and USAC are not conversational, but corresponds to storing and disseminating services, without strong constraints on the algorithmic delay.

The initial version of the USAC codec, called RM0 (Reference Model 0), is described in the paper by M. Neuendorf et al., A Novel Scheme for Low Bitrate Unified Speech and Audio Coding—MPEG RM0, 7-10 May 2009, 126th AES Convention. This RM0 codec alternates between several coding modes:

- For speech type signals: LPD modes (for "Linear Predictive Domain") comprising two different modes derived from the AMR-WB+ coding:
  - An ACELP mode
  - A TCX (Transform Coded eXcitation) mode called wLPT (for "weighted Linear Predictive Transform") using an MDCT type transform (unlike the AMR-WB+ codec which uses a FFT ("Fast Fourier transform").
- For music type signals: FD mode (for "Frequency Domain") using an MDCT transform coding (for "Modified Discrete Cosine Transform") of MPEG AAC type (for "Advanced Audio Coding") over 1024 samples.

In the USAC codec, the transitions between LPD and FD modes are crucial for ensuring a sufficient quality without switching flaws, knowing that each mode (ACELP, TCX, FD) has a specific "signature" (in terms of artefacts) and that the FD and LPD modes are different in nature—the FD mode is based on transform coding in the signal domain, whereas the LPD modes use predictive linear coding in the perceptual weighted domain with filter memories to correctly manage. Intermodal switching management in the USAC RM0 codec is detailed in the paper by J. Lecomte et al., "*Efficient cross-fade windows for transitions between LPC-based and non-LPC based audio coding*", 7-10 May 2009, 126th AES Convention. As explained in this paper, the main difficulty is the transitions from LPD to FD modes and vice versa. Only the case of CELP to FD transitions is considered here.

In order to fully understand how it works, the principle of MDCT transform coding is recalled through a typical example of development.

At the coder the MDCT transformation is typically divided into three steps, the signal being split into frames of M samples prior to MDCT coding:

- Weighting the signal by a window here called "MDCT window" with length 2M.
- Time-domain aliasing for forming a block with length M.
- DCT transforming (for "Discrete Cosine Transform") with length M The MDCT window is divided into four adjacent portions with equal lengths M/2, here called "quarters".

The signal is multiplied by the analysis window, and then aliasing is performed: the first quarter (windowed) is aliased (i.e. time reversed and overlapped) on the second quarter and the fourth quarter is aliased on the third.

More precisely, time-domain aliasing a quarter on another is performed in the following way: the first sample of the first quarter is added to (or subtracted from) the last sample of the second quarter, the second sample of the first quarter is added to (or subtracted from) the penultimate sample of the second quarter, and so on, until the last sample of the first quarter which is added to (or subtracted from) the first sample of the second quarter.

Therefore, from four quarters, 2 aliased quarters are obtained where each sample is the result of a linear combination of 2 signal samples to code. This linear combination induces time-domain aliasing.

The 2 aliased quarters are then jointly coded after the DCT transformation (of type IV). For the following frame there is a shift by half of a window (i.e. 50% of overlap), the third and fourth quarters of the preceding frame then become the first and the second quarter of the current frame. After aliasing, a second linear combination of the same sample pairs is sent like in the preceding frame, but with different weights.

At the decoder, after the DCT transformation, the decoded version of these aliased signals is therefore obtained. Two consecutive frames contain the result for two different aliasing events of the same quarters, i.e. for each sample pair there is the result for two linear combinations with different but known weights: an equation system may therefore be solved to obtain the decoded version of the input signal, time-domain aliasing may thus be eliminated using two consecutive decoded frames.

Solving the mentioned equation systems is generally implicitly performed by opening, multiplication by a synthesis window which is judiciously chosen, and then adding and overlapping the common parts (without discontinuity due to quantization errors) between 2 consecutive decoded frames, indeed this operation behaves like a an overlap-add. When the window for the first quarter or the fourth quarter is at zero for each sample, it is referred to an MDCT transformation without time-domain aliasing in this part of the window. In this case the smooth transition is not ensured by the MDCT transformation, it must be made by other means such as for example an external overlap-add.

It should be noted that there are variants of implementations for the MDCT transformation, in particular for defining the DCT transform, on the way of time-domain aliasing the block to transform (for example, signs applied to the quarters aliased left and right may be reversed, or the second and the third quarter may be aliased on the first and fourth quarters respectively), etc. These variants do not change the MDCT analysis-synthesis principle with sample block reduction by windowing, time-domain aliasing, then transforming, and finally windowing, aliasing, and adding-overlapping.

In the case of the USAC RM0 coder described in the paper by Lecomte et al., the transition between a frame coded by ACELP coding and a frame coded by FD coding, is performed in the following way:

A transition window for the FD mode is used with an overlap to the left of 128 samples.

Time-domain aliasing on this overlap area is cancelled by introducing an artificial time-domain aliasing to the right of the reconstructed ACELP frame. The MDCT windows used for the transition has a size of 2304 samples and the DCT transformation operates on 1152 samples whereas normally the FD mode frames are coded with a window with a size of 2048 samples and a DCT transformation of 1024 samples. Thus the MDCT transformation of the normal FD mode is not directly usable for the transition window, the coder must also integrate a modified version of this transformation which complicates the transition implementation for the FD mode.

This coding technique from the state-of-the-art has an algorithmic delay in the order of 100 to 200 ms. This delay is incompatible with conversational applications for which the coding delay is generally in the order of 20 to 25 ms for speech coders for the mobile applications (e.g. GSM EFR, 3GPP AMR and AMR-WB) and in the order of 40 ms for conversational transform coders for videoconferencing (for example UIT-T G.722.1 Annex C and G.719). Moreover, occasionally increasing the DCT transformation size (2304 vs 2048) causes a peak in complexity at the moment of transition.

To overcome these disadvantages, the international patent application WO2012/085451, wherein the content is incorporated by reference to the present application, proposes a new method of coding a transition frame. The transition frame is defined as the transform coded current frame following a preceding frame coded by predictive coding. According to the above-mentioned new method, part of the transition frame, for example a sub-frame of 5 ms, in the case of CELP coding at 12.8 GHz, and two extra CELP frames of 4 ms each, in the case of a CELP coding at 16 kHz, are coded by predictive coding restricted with respect to predictive coding the preceding frame.

The restricted predictive coding consists in using the stable parameters of the preceding frame coded by predictive coding, such as for example the linear prediction filter coefficients and in only coding some minimum parameters for the extra sub-frame in the transition frame.

As the preceding frame has not been coded with transform coding, cancelling time-domain aliasing in the first part of the frame is impossible. The above-mentioned patent application WO2012/085451 further proposes to modify the first half of the MDCT window so as to not have time-domain aliasing in the first quarter which is usually aliased. It is also proposed to integrate part of the overlap-add between the decoded CELP frame and the decoded MDCT frame by modifying the coefficients of the analysis/synthesis window. In reference to FIG. 4*e* from the above-mentioned application, the chain-dotted lines (lines alternating between dots and dashes) corresponds to MDCT coding aliasing lines (top figure) and to the MDCT decoding aliasing lines (bottom figure). On the top figure, the bold lines separate the frames of new samples at the coder input. Coding a new MDCT frame may be initiated when a frame as defined for new input samples is completely available. It is important to note is that these bold lines at the coder do not correspond to the current frame the two successive blocks of new samples arriving for each frame: the current frame is in fact delayed by 8.75 ms corresponding to anticipation, named "lookahead". On the bottom figure, the bold lines separate the decoded frames at the decoder output.

At the coder, the transition window is null until the aliasing point. Thus the coefficients of the left part of the aliased window are identical to those of the non-aliased window. The part between the aliasing point and the end of this transition (TR) CELP sub-frame corresponds to a sinusoidal half-window. At the decoder, after opening, the same window is applied to the signal. On the segment between the aliasing point and the start of the MDCT frame, the window coefficients correspond to a $\sin^2$ window. To ensure the addition-overlap between the decoded CELP sub-frame and the signal originating from the MDCT, only applying a $\cos^2$ type window to the part of the CELP sub-frame in overlap and to sum the latter with the MDCT frame is required. The method is of perfect reconstruction.

However, the application WO2012/085451 provides allocating a bit budget $B_{trans}$ for coding the CELP sub-frame corresponding to the required budget for CELP coding a classic frame, brought down to a single sub-frame. The remaining budget for transform coding the transition frame is then insufficient and might lead to a quality decrease at low rate.

SUMMARY

The present invention improves the situation

For this purpose, a first aspect of the invention relates to a method of determining a distribution of bits for coding a transition frame. This method is implemented in a coder/decoder for coding/decoding a digital signal. The transition frame is preceded by a predictive coded preceding frame and coding this transition frame comprises transform coding and predictive coding a single sub-frame of the transition frame. The method further comprises the following steps:

- assigning a bit rate for predictive coding the transition sub-frame, the bit rate being equal to the minimum between the bit rate for transform coding the transition frame and a first predetermined bit rate value;
- determining a first number of bits allocated for predictive coding the transition sub-frame for the bit rate; and
- calculating a second number of bits allocated for transform coding the transition frame from the first number of bits and a number of bits available for coding the transition frame.

The predictive coding bit rate is thus curbed by a maximum value. The number of bits allocated for predictive coding depends on this bit rate. Since the weaker the bit rate, the weaker the number of bits allocated for coding is, a minimum remaining budget for transform coding the transition frame is guaranteed.

Moreover, the number of bits allocated for predictive coding the sub-frame is optimized with respect to the transform coding bit rate. Indeed, if the bit rate for transform coding the transition frame is lower than the first predetermined value, the bit rate for predictive coding and the bit rate for transfer coding are identical. Signal coherence thus generated is therefore improved which simplifies the subsequent steps of coding (channel coding) and processing the received frames at the decoder.

In another embodiment, the coder/decoder comprises a first core working, for predictive coding/decoding a signal frame, at a first frequency, and a second core working, for predictive coding/decoding a signal frame, at a second frequency. The first predetermined bit rate value depends on the core selected from the first and second cores for coding/decoding the predictive coded preceding frame.

The working frequency of the coder/decoder core has an influence on the number of bits required for correctly representing the input digital signal. For example, for some working frequencies, additional bits must be provided for coding frequency bands which are non-directly processed by the core.

In an embodiment, when the first core has been selected for coding/decoding the predictive coded preceding core, the assigned bit rate also equal to the maximum between the bit rate for the transform coded transition frame and the second predetermined bit rate value, the second value being lower than the first value. Thus, a minimum bit rate is guaranteed in order to prevent rates differences being too large between the different coded frames.

In another embodiment, the digital signal is decomposed into at least one frequency low band and one frequency high band. In this situation, the first calculated number of bits is assigned for predictive coding the transition frame for the frequency low band. A third predetermined number of bits is thus allocated for coding the transition sub-frame for the frequency high band. Moreover, the second number of bits allocated for transfer coding the transition frame is then further determined from the third predetermined number of bits. Thus, it is possible to efficiently code the whole frequency spectrum of the input signal without sacrificing the quality of signal restored upon decoding.

In an embodiment, the number of bits available for coding the transition frame is fixed. This reduces the complexity of the coding steps.

In another embodiment, the second number of bits is equal to the fixed number of bits for coding the transition frame minus the first number of bits minus the third number of bits. The final determination of the distribution of bits in the transition frame is thus limited to subtracting the entire values which simplifies coding.

Alternatively, the second number of bits is equal to the fixed number of bits for coding the transition frame minus the first number of bits minus the third number of bits minus a first bit minus a second bit. The first bit indicates whether a low-pass filtering is performed during the determination of predictive coding parameters for the transition sub-frame, the parameters being relative to the tonal lead time. The second bit indicates the frequency used by the coder/decoder core for predictive coding/decoding the transition sub-frame. Such indication allows more flexible coding.

A second aspect of the invention relates to a method of coding a digital signal in a coder able to code signal frames according to predictive coding or according to transform coding, comprising the following steps:

- Coding a preceding frame of digital signal samples according to predictive coding;
- Coding a current frame of digital signal samples in a transition frame, coding the transition frame comprising transform coding and predictive coding a single sub-frame of the transition frame, coding the current frame comprising the following sub-steps:
  - determining the distribution of bits via the method according to the first aspect of the invention;
  - transform coding the transition frame on the second number of allocated bits;
  - predictive coding the transition sub-frame on the first number of allocated bits.

Determining the distribution of bits comprised in the transition frame is thus determined prior to coding. As described below, determining the distribution of bits is reproducible at the decoder which prevents an explicit transmission of information about this distribution.

Moreover, this coding guarantees a balanced distribution between predictive coding and transform coding within this transition frame.

In an embodiment, predictive coding comprises generating determined predictive coding parameters for the bit rate assigned during the distribution of bits in the transition frame. The use of such predictive parameters allows optimising the ratio between the bit rate assigned for predictive coding and the rate remaining assigned for transform coding, and therefore optimizing the quality of the reconstructed signal. Indeed, at constant quality, the number of bits attributed for this predictive parameter or another may vary in non-linear proportions with respect to the bit rate assigned for predictive coding.

In another embodiment, predictive coding comprises generating predictive coding parameters restricted with respect to predictive coding the preceding frame by reusing at least one predictive coding parameter of the preceding frame. Thus, upon decoding, additional information is extracted from the preceding frame to complete decoding the transition sub-frame to decode. This reduces the number of bits that must be reserved for predictive coding the transition sub-frame.

The combination of reusing parameters from a preceding frame and assigning the bit rate for transform coding the transition frame allows ensuring a coherent transition at low-cost.

A third aspect of the invention relates to a method of decoding a digital signal coded by predictive coding and transform coding, comprising the steps of:

- predictive decoding a preceding frame of digital signal samples coded according to predictive coding;
- decoding a transition frame coding a current frame of digital signal samples, including the transition frame comprising transform coding and predictive coding a single sub-frame of the transition frame, comprising the sub steps of:
  - determining the distribution of bits by the method according to the first aspect of the invention;
  - predictive decoding the transition sub-frame on the first number of allocated bits;
  - transform decoding the transition frame on the second number of allocated bits.

As mentioned above, the method of determining the distribution of bits in the transition frame is directly reproducible at the decoder. Indeed, the distribution of bits is determined only from the bit rate from the transform coded part of the transition. Therefore, no extra bit is necessary for implementing the step of determining the distribution of bits and bandwidth savings are therefore made.

A fourth aspect of the invention further aims for a computer program comprising instructions for implementing the method according to the aspects of the invention described above, when these instructions are executed by processor.

A fifth aspect of the invention relates to a device for determining a distribution of bits for coding a transition frame, this device being implemented in a coder/decoder for coding/decoding a digital signal, the transition frame being preceded by a predictive coded preceding frame, coding the transition frame comprising transform coding and predictive coding a single sub-frame of the transition frame, the number of bits for coding the transition frame being fixed, the device comprising a processor arranged for performing the following operations:

assigning a bit rate for predictive coding the transition sub-frame, said bit rate being equal to the minimum between the bit rate for transform coding the transition frame and a first predetermined bit rate value;

determining a first number of allocated of bits allocated for predictive coding the transition sub-frame for the bit rate;

calculating a second number of bits allocated for transform coding the transition frame from the first required number of bits for coding the coding parameters and the fixed number of bits for coding the transition frame.

A sixth aspect of the invention further aims for a coder able to code frames for a digital signal according to predictive coding or according to transform coding, comprising:

a device according to the fifth aspect of the invention;

a predictive coder comprising a processor arranged for performing the following operations:

coding a preceding frame of digital signal samples according to predictive coding;

predictive coding a single sub-frame comprised in a transition frame coding a current frame of digital signal samples, coding the transition frame comprising transform coding and predictive coding the sub-frame, the processor being arranged for performing the predictive coding operation for the transition sub-frame on the first number of allocated bits;

a transform coder comprising a processor arranged for transform coding the transition frame on the second number of allocated bits.

A seventh suspect of the invention further aims for a decoder for a digital signal coded by predictive coding and transform coding, comprising:

a device according to the fifth aspect of the invention;

a predictive decoder comprising a processor arranged for performing the following operations:

predictive decoding a preceding frame of digital signal samples coded according to predictive coding;

predictive decoding a single sub-frame comprised in a transition frame coding a current frame of digital signal samples, coding the transition frame comprising transform coding predictive coding the sub-frame, the processor being arranged for performing the operation of predictive decoding the transition sub-frame and the first number of allocated bits;

a transform decoder comprising a processor arranged for transform coding the transition frame on the second number of allocated bits.

BRIEF DESCRIPTION OF THE DRAWINGS

Other features and advantages of the invention will appear upon examining the detailed description below, and the accompanying drawings on which.

DETAILED DESCRIPTION

Figure 1:
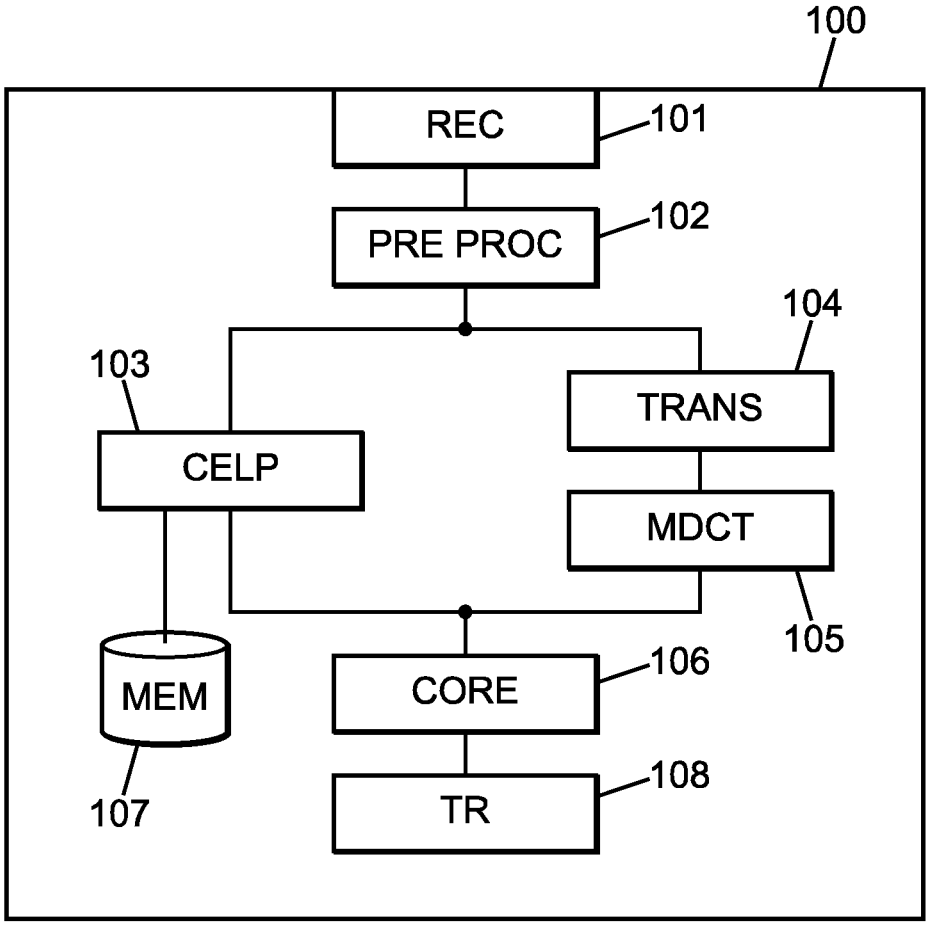
FIG. 1 illustrates an audio coder according to an embodiment of the invention.

FIG. 1 illustrates an audio coder 100 according to an embodiment of the invention.

Figure 2:
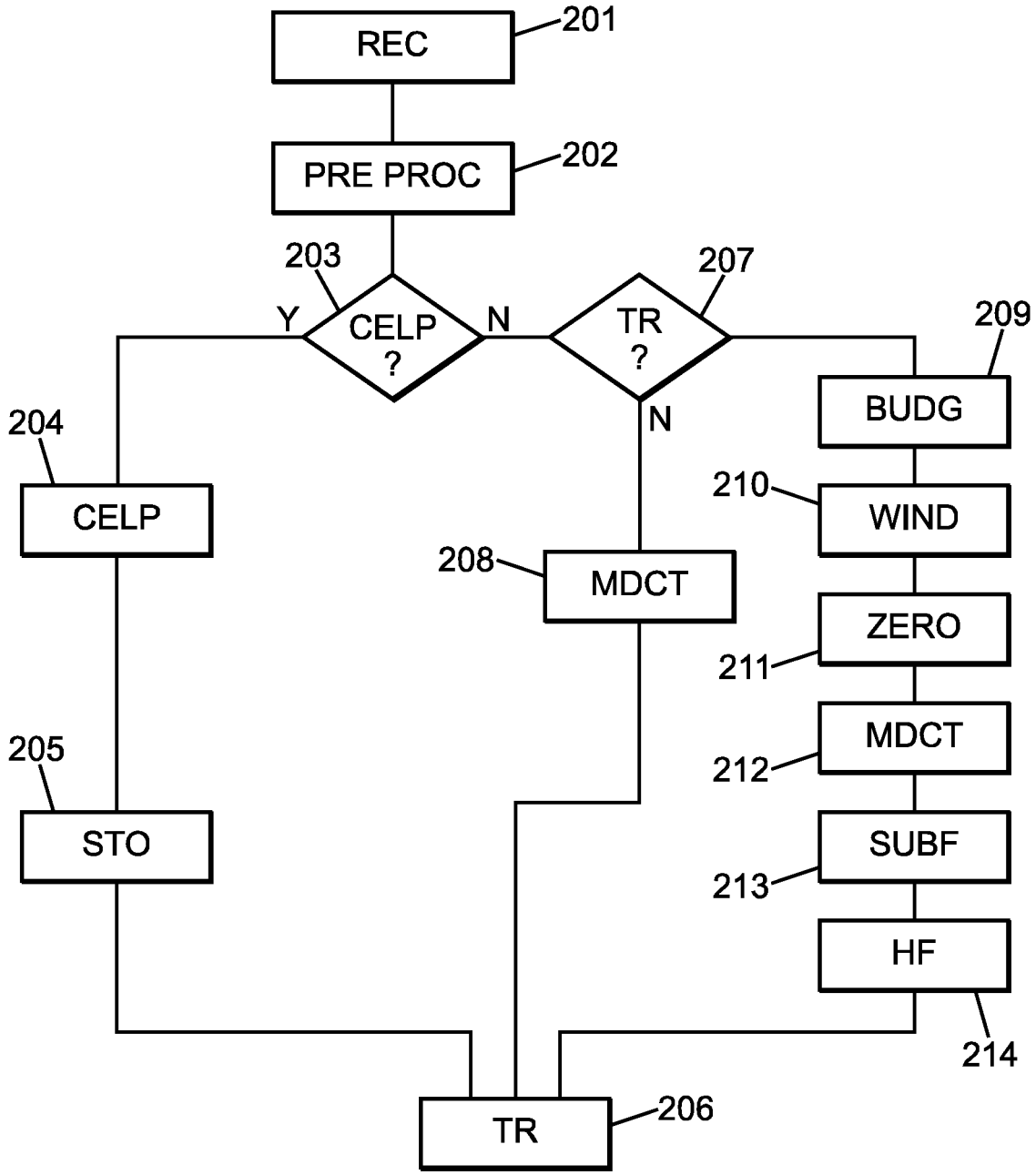
FIG. 2 is a diagram illustrating the steps of the coding method, implemented by the audio coder of FIG. 1, according to an embodiment of the invention.

FIG. 2 is a diagram illustrating the steps of a method of coding, implemented by the audio coder 100 of FIG. 1, according to an embodiment of the invention.

The coder 100 comprises a receiving unit 101 for receiving, at step 201, an input signal samples at a given frequency fs (for example 8, 16, 32, or 48 kHz) and decomposed into sub-frames, for example of 20 ms.

Upon receiving a current frame, a pre-processing unit 102 is able to select, at step 202, the coding mode which is most adequate for coding the current frame, between at least one LPD mode and one FD mode. In the following description, it is considered, for illustrative purposes, that MDCT coding is used for the FD mode and that CELP coding is used for the LPD mode. There is no restriction on the coding techniques employed for the LPD and FD modes respectively. Thus, modes in addition to the CELP and MDCT modes may be used for example, CELP coding may be replaced with another type of predictive coding, the MDCT transform may be replaced with another type of transform.

It is assumed here that the frame type is explicitly transmitted via the block 206, with for example fixed length coding indicating the mode chosen from a predefined list. In variants of the invention, this coding for the mode chosen in each frame may be of variable length. It is also provided that the CELP coding type (12.8 or 16 kHz) may be explicitly transmitted through a bit so as to facilitate decoding the transition frame.

Step 203 verifies that CELP decoding has been selected at step 202. In cases where the LPD mode is selected, the signal frame is transmitted to a CELP coder 103 for coding a CELP frame at step 204. The CELP coder may use two "cores" working at two respective internal sampling frequencies, for example fixed at 12.8 kHz and 16 kHz, which require the use of sampling of the entry signal (at frequency fs) at an internal frequency of 12.8 or 16 kHz. Such re-sampling may be implemented in a re-sampling unit in the pre-processing block 102 or in the CELP coder 103. The frame is then predictive coded by the CELP coder 103 by deducting the CELP parameters generally depending on a signal categorisation. The CELP parameters typically include LPC coefficients, a fixed and adaptive gain vector, an adaptive dictionary vector, a fixed dictionary vector. This list may also be modified based on a signal category in the frame, such as in UIT-T G.718 coding. The parameters thus calculated may then be quantified, multiplexed, and transmitted at step 206 to the decoder by a transmitting unit 108. The CELP coding parameters, such as the LPC coefficients, the fixed and adaptive gain vector, the adaptive dictionary vector, the fixed dictionary vector, and the CELP decoder states may further be memorised, at step 205, in a memory 107 in cases where the frame following the current frame is an MDCT transition frame.

As explained below, a band extension may also be performed with coding associated with the high band when the current frame is of CELP type.

In cases where MDCT coding has been selected by the unit 102 at step 203, it is verified at step 207 that the frame preceding the current frame has been MDCT transform coded. In cases where the frame preceding the current frame has been MDCT transform coded, the current frame is transmitted to the MDCT coder 105 directly, for MDCT transform coding the current frame at step 208. The MDCT coder may code a frame covering 28.75 ms of non-re-sampled signal, including 20 ms of frame and 8.75 ms of lookahead for example. There is no restriction on the MDCT window size. Furthermore, a delay corresponding to the CELP coder delay due to the re-sampling of the input signal, is applied to the frame coded by the MDCT coder, in such a way that the MDCT and CELP frames are synchronized. Such delay at the coder may be of 0.9375 ms according to the re-sampling type before CELP coding. The MDCT transform coded frame is transmitted to the decoder at step 206.

In cases where MDCT coding is selected by the unit 102, and in cases where the frame preceding the current frame has been predictive coded, the current frame a transition frame and is transmitted to a transition unit 104. As described in the following, the MDCT transition frame comprises an extra CELP sub-frame.

The transition unit 104 is able to implement the following steps:

- anticipating, at step 209, the budget of bits required for coding the transition CELP sub-frame so as to define the budget available for MDCT coding the current frame. As detailed in the following, the budget may depend on the current frame rate. Furthermore, the budget may be evaluated depending on the CELP core used. In order to preserve a sufficient bit budget for not degrading the quality of MDCT coding, the invention may provide confining the coding rate for the CELP sub-frame. For this purpose, it comprises a device for determining the distribution of bits in a transition frame, such as the device 700 of FIG. 7;
- modifying, at step 210, the MDCT window used at the coder in compliance with FIG. 3 described below;
- zeroing the MDCT transformation memory since the preceding frame is a CELP frame, at step 207—in the same manner the MDCT memory may be ignored in MDCT decoding.

In an embodiment, at least one of these steps is performed by the transition frame coding unit 106 described below.

The transition MDCT frame is coded by the MDCT coder 105, at step 212, as described in the following, and based on a budget of bits allocated at step 209. The extra CELP sub-frame is also coded by a CELP coder 103, at step 213, as described in the following in reference to FIG. 3, and depending on a bit budget allocated at step 209. CELP coding may be performed before or after MDCT coding.

Figure 3:
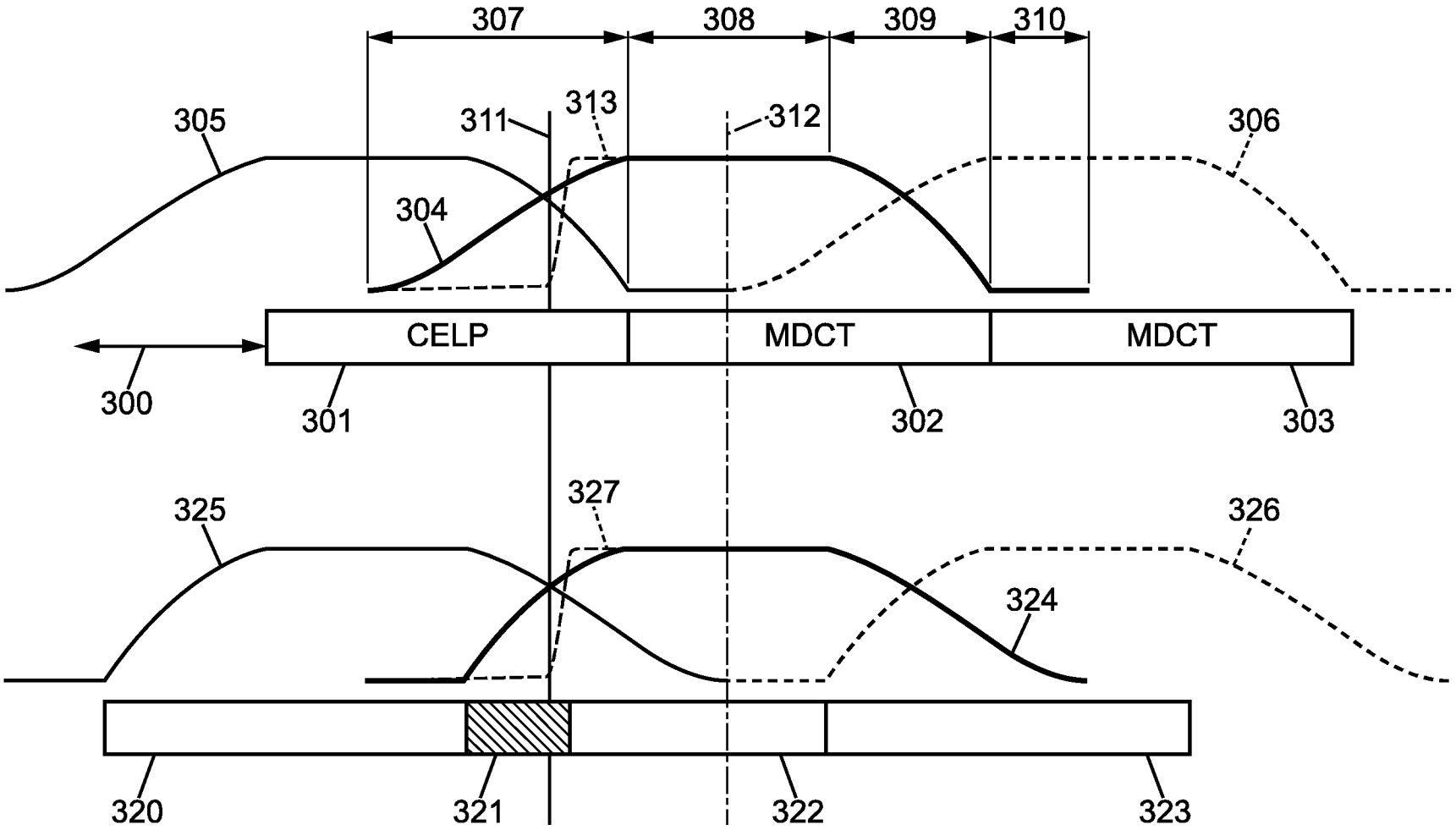
FIG. 3 shows a transition between the CELP and MDCT frames according to an embodiment of the invention.

FIG. 3 shows the transition between CELP and MDCT frames at the coder, before coding, and at the decoder, before decoding.

A frame to code 301 is received at the coder 100 and is coded by the CELP coder 103. A current frame 302 is then received by input of the coder 100 to be MDCT transform coded. It is thus a transition frame. The following frame 303 received by input of the coder is also MDCT transform coded. According to the invention, the following frame 303 may be coded by CELP coding and there is no restriction on coding used for the following frame 303.

An asymmetric MDCT window 304 may be used for coding the current frame. This window 304 shows a rising edge 307 of 14.375 ms, a level with a gain at 1 of 11.25 ms, a falling edge 309 of 8.75 ms corresponding to the lookahead, and a null part 310 of 5.265 ms. Adding the null part 310 allows reducing the lookahead and thus the corresponding delay. In an embodiment, the form of this MDCT analysis window for MDCT coding is modified for example for further reducing the lookahead or for using a symmetric window with examples given in the patent application WO2012/085451.

The dashed lines 312 represent the medium of the MDCT window 304. On both sides of the line 312, the 10 ms quarters of the MDCT window 212 are aliased as described in the introductory part. The continuous line 311 indicates the aliasing area between the first and second quarters of the MDCT window 304. The MDCT window of the following frame 303 is referenced 306 and shows an overlap-add area with the MDCT window 304 corresponding to the falling edge 309 of the MDCT window 304.

An MDCT window 305 theoretically represents the window which will be applied to the preceding window if it has been MDCT transform coded. However, the preceding frame 301 being coded by the CELP coder 103, it is necessary, in order to allow opening of the first part of the MDCT transform coded frame at the decoder, that the window is null in the first quarter (since the second part of the preceding MDCT frame is not available).

For this purpose, the MDCT window 304 is modified by an MDCT window 313 having a first quarter at zero, allowing time-domain aliasing in the first part of the MDCT frame at the decoder.

At the decoder, the analysis windows 304, 305, 306, and 313 correspond to synthesis windows 324, 325, 326, and 327 respectively. This synthesis window is therefore time-reversed with respect to the corresponding analysis window. In variants of the invention, the analysis and synthesis windows may be identical, of sinusoidal type or other.

A first frame 320 of new samples coded by CELP coding is received at the decoder. It corresponds to the coded version of this CELP frame 301. It is here recalled that the decoded frame is shifted by 8.75 ms with respect to the frame 320.

The coded version of the transition frame 302, is then received (references 321 and 222 forming a complete frame). Between the end of the CELP frame 320 and the start of the rising edge of the synthesis window 327 (corresponding to the aliasing line), a gap is created. In the particular example represented here, a quarter of the MDCT window being 10 ms and the null part of the synthesis window MDCT 324 covering this CELP frame 220 being 5.625 ms (corresponding to the part 310 of the MDCT analysis window 204), the gap is 4.275 ms. Furthermore, to ensure that a satisfying overlap-add length with the start of the non-null part of the MDCT window 327, the delay between this CELP frame 320 and the start of the MDCT window 327 is prolonged to the required length. In the following example, for illustrative purposes, a satisfying overlap-add length of 1.875 ms is considered, the above-mentioned delay (corresponding to a missing signal length) thus being brought up to 6.25 ms, as represented by reference 321 on FIG. 2.

It should be noted that the signal frames represented on FIG. 3 may contain signals at different sampling frequencies of 12.8 or 16 kHz in cases of CELP coding/decoding and of fs in cases of MDCT coding/decoding; however at the decoder, after re-sampling of the CELP synthesis and time shift of the MDCT synthesis, the frames remain synchronised and the representation of FIG. 3 remains exact.

As previously mentioned the application WO2012/085451 proposes to code an extra CELP sub-frame of 5 ms at the start of the MDCT transition frame, in cases of 12.8 kHz CELP coding, and two extra CELP frames of 4 ms each at the start of the MDCT transition frame, in cases of 16 kHz CELP coding.

In cases of 12.8 kHz, the 6.25 ms delay is not filled and the overlap-add is affected: there are only 0.625 ms of overlap-add at the decoder, which is insufficient.

In the case of 16 kHz, two extra CELP sub-frames are coded at the start of the transition frame, which only leaves a very little budget for coding the transition MDCT frame and may lead to a significant quality decrease at low rate.

In order to overcome these disadvantages, the present invention may provide coding a single extra CELP sub-frame at 12.8 or 16 kHz by the CELP coder 103. The extra samples are generated at the decoder, as detailed in the following, in order to generate the missing signal on the above-mentioned 6.25 ms length.

In order to code the transition CELP sub-frame, the unit 106 may reuse at least one CELP parameter of the preceding CELP frame. For example, the unit 106 may reuse the linear prediction coefficient A(z) of the preceding CELP sub-frame as well as the energy from the preceding frame innovation (stored in the memory 107 such as previously described) in order to code only the adaptive dictionary vector, the adaptive gain, the fixed gain, and the fixed dictionary vector of the transition CELP sub-frame. Thus, the extra CELP sub-frame may be coded with the same core (12.8 kHz or 16 kHz) as the preceding CELP frame.

A transition frame coding unit 106 ensures coding the transition frame according to the invention. The invention may further provide the insertion by the unit 106 in the bit flow of an extra bit indicating that the coded frame 322 is a transition frame, however in general cases this transition frame indication may also be transmitted in the global indication of the current frame coding mode, without taking extra bits.

The invention may further provide that this unit 116 codes the signal high band at steps 204 and 214 (method of so-called "band extension"), when the latter is required, with a fixed budget since the sampling frequency of the synthesis signal at the decoder is not necessarily identical to the CELP core frequency.

For this purpose, the coding unit of the transition frame 106 may implement the following steps:

filtering the CELP preceding frame and the CELP sub-frame of the transition frame by a high-pass filter in order to preserve the high part of the spectrum (above the frequency corresponding to the used CELP core, i.e. above 6.4 or 8 kHz). Such filtering may be implemented by a filter with finite impulse response, FIR, from the CELP coder 103;

searching correlation between the filtered part of the original transition CELP sub-frame and the filtered preceding CELP frame in order to estimate a delay parameter and then a gain (amplitude difference between the signal corresponding to the filtered sub-frame and the signal predicted by applying the delay);

coding the delay parameter and the above-mentioned gain using for example scalar quantification (for example, the delay may be coded over 6 bits and the gain over 6 bits).

Figure 4:
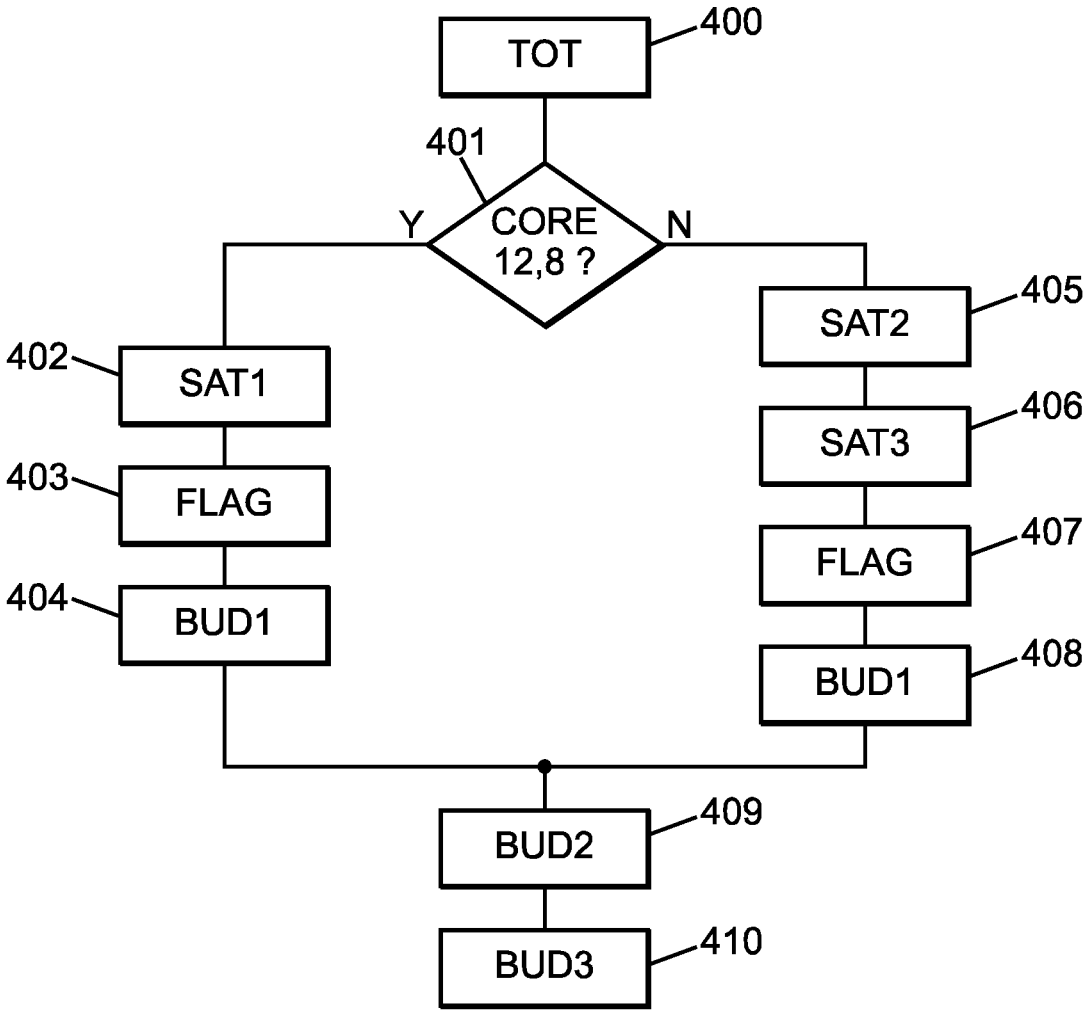
FIG. 4 is a diagram illustrating the steps of a method of determining a distribution of bits for coding a transition frame, according to an embodiment of the invention.

The above-mentioned step 209 is illustrated in more details in reference to FIG. 4 which is a diagram illustrating the steps of a method of determining a distribution of bits for transition coding according to an embodiment of the invention. The above-mentioned method is performed in the same manner at the coder and at the decoder, but is shown, for illustrative purposes only, on the coder side.

At step 400, the total rate (in bit/s), noted core_brate, which may be allocated to coding the current framed is fixed as being equal to the output rate of the MDCT coder. The duration of the frame being considered in this example as 20 ms, the number of frames per second is 50 and the total budgets in bits is equal to core_brate/50. The total budget may be fixed, in the case of a fixed rate coder, or variable, in the case of a variable rate coder when adapting to the coding rate is implemented. In the following, an num_bits variable is used, initialised at the value of core_brate/50.

At step 401, the transition unit 104 determines the CELP core, from at least two CELP cores, which has been used for coding this preceding CELP frame. In the following example, two CELP cores are considered, working at frequencies of 12.8 kHz and 16 kHz respectively. Alternatively, a single CELP core is implemented upon coding and/or upon decoding.

In the case where the CELP core used for the preceding CELP frame has a 12.8 kHz frequency, the method comprises a step 402 of assigning a bit rate, labelled cbrate, for CELP coding the transition sub-frame, the bit rate being equal to the minimum between the bit rate for MDCT coding of the transition frame and a first predetermined bit rate value. The first predetermined value may be fixed at 24.4 kbit/s for example, which allows to ensure a satisfying bit budget for transfer coding.

Thus, cbrate=min(core_bitrate, 24400). This limitation is equivalent to curbing the operation of the restricted CELP coding limited to an extra sub-frame with the coded CELP parameters as if they were coded by CELP coding with at most 24.40 kbit/s.

At an optional step 403, the assigned bit rate is compared to a 11.60 kbit/s CELP bit rate. If the assigned bit rate is higher, a bit may be reserved for coding a bit indication for low pass filtering the adaptive dictionary (such as for example for AMR-WB coding at rates higher or equal to 12.65 kbit/s). The num_bits variable is updated:

num_bits:=num_bits−1

At step 404, a first number of bits, labelled budg1, is allocated for predictive coding the additional CELP sub-frame. The first number of bits budg1 represents the number of bits representing the CELP parameters used for coding the CELP sub-frame. As previously detailed, coding the CELP sub-frame may be restricted in that a restricted number of CELP parameters is used, some parameters used for coding the preceding CELP frame being reused advantageously.

For example, only the excitation may be modelled for coding the extra CELP sub-frame, and bits are thus reserved only for the fixed dictionary vector, for the adaptive dictionary vector, and for the gain vector. The number of bits attributed to each of these parameters is deduced from the bit rate assigned for coding this extra CELP sub-frame at step 402. For example, Table 1/G722.2—Distribution of bits for the AMR-WB coding algorithm for a 20 ms frame, originating from the July 2003 version of the G.722.2 of the ITU-T, gives examples of bit allocations by a CELP parameter depending on the assigned bit rate.

In the previous example, where coding the sub-frame is restricted, budg1 corresponds to the sum of bits attributed to the adaptive dictionary, to the fixed dictionary, and to the gain vector respectively. For example, for an assigned bit rate of 19.85 kbit/s, by referring to the above-mentioned Table1/G722, 9 bits are allocated to the fixed dictionary (tonal lead time), and 7 bits are allocated to the gain vector (directory gain). In this case, budg1 is equal to 88 bits.

The num_bits variable may thus be updated:

num_bits:=num_bits−budg1

The invention may also provide taking into account the frame categories in the allocation of bits to the CELP parameters. For example, the G.718 norm of the ITU-T, in its June 2008 version, sections 6.8 and 8.1, gives the budgets to allocate to each CELP parameter depending on categories, or modes such as non-voiced mode (UC), the voiced mode (VC), the transition mode (TC), and the generic mode (GC), and depending on the allocated bit rate (layer1 or layer2, corresponding to rates of 8 kbit/s and 8+4 kbit/s, respectively). The coder G.718 is a hierarchic coder, but it is possible to combine the CELP coding principles using a G 718 categorisation with the multi-rate allocation of AMR-WB.

If it has been determined at step 401 that the CELP core used for the preceding CELP frame has a 16 kHz frequency, the method comprises a step 405 of assigning a bit rate, labelled cbrate, for CELP coding the transition sub-frame, the bit rate being equal to the minimum between the bit rate for MGCT coding the transition frame and a first predetermined value of the bit rate. In the case of the 16 kHz core, the first predetermined value may be fixed at 22.6 kbit/s for example, which allows to ensure a satisfying bit budget for transform coding. Thus, the first predetermined value depends on the CELP core used for code the preceding CELP frame. Furthermore, for coding the 16 kHz core, threshold values may be applied when assigning a bit rate to CELP coding. Thus, the assigned bit rate is further equal to the maximum between the bit rate for the transform coded transition frame and at least one predetermined second bit rate value, the second value being lower than the first value. The second predetermined value of the trade may for example be 14.8 kbit/s. Thus, if the bit rate for the transform coded transition frame is lower than 14.8 kbit/s, the bit rate assigned for CELP coding the transition sub-frame may be 14.8 kbit/s.

In a complementary embodiment, if the bit rate for the transform coded transition frame is lower than 8 kbit/s, the assigned rate may be 8 kbit/s.

Thus, according to this complementary embodiment, the following algorithm is obtained:

```
If core_bitrate ≤ 8000
    cbrate = 8000
Otherwise if core_bitrate ≤ 14800
    othercbrate = 14800
Otherwise
    cbrate= min(core_bitrate , 22600)
End if
```

-continued

At an optional step 407, the assigned bit rate is compared to a CELP bit rate of 11.60 kbit/s. If the assigned bit rate is higher, a bit may be reserved for coding a low-pass filtering bit indication of the adaptive dictionary. The num_bits variable is updated:

num_bits:=num_bits−1

At step 408, in the same manner as that of step 404, a first number of bits budg1 is allocated for predictive coding the extra CELP sub-frame, and budg1 depends on the bit rate assigned for CELP coding the transition sub-frame.

At step 410 which is common to coding at various core frequencies, a second number is allocated for transform coding the transition frame, labelled budg2, is calculated from the first number of bits budg1 the total number of bits of the transition frame. Regarding the calculations above, budg2 is equal to the num_bits variable. Generally, the mode of the transition current frame is here assumed to be imputed to the MDCT coding budget, this information is thus not explicitly taken into account.

The preceding steps may have been implemented for coding a frequency low band of the transition sub-frame, in cases where the audio signal is decomposed into at least one frequency low band and one frequency high band. At an optional step 409 preceding step 410, also common to coding at different core frequencies, the method may comprise allocating a third predetermined number of bits, labelled budg3 for coding the frequency high band of the transition sub-frame. In this case, the second number of bits budg2 is calculated both from the first number of bits budg1 and the third number of bits budg3.

As previously explained, coding the frequency high band (or extending the band) of the transition sub-frame may be based on a correlation between the preceding frame of the audio signal and the transition sub-frame. For example, coding the frequency high band may be decomposed into two steps.

In the first step, the preceding frame and the current frame of the audio signal are filtered by a high pass filter to only keep the higher part of the spectrum. The high part of the spectrum may correspond to frequencies higher than that of the CELP core used. For example, if the CELP core used is the 12.8 kHz CELP core, the high band corresponds to the audio signal for which the frequencies lower than 12.8 kHz have been filtered. Such filtering may be implemented by means of an FIR filter.

In a second step, searching a correlation between the filtered parts of the preceding frame and the current frame is implemented. Such correlation search allows estimating a delay parameter and then a gain. The gain corresponds to the amplitude ratio between the filtered part of the current frame and the signal predicted by applying the delay.

For example, 6 bits may be allocated for the gain and 6 bits for the delay. The third number of bits budg3 is then equal to 12.

The num_bits variable may then be updated:

num_bits:=num_bits−budg3.

The second number of bits budg2 is then equal to the updated num_bits variable.

Figure 5:
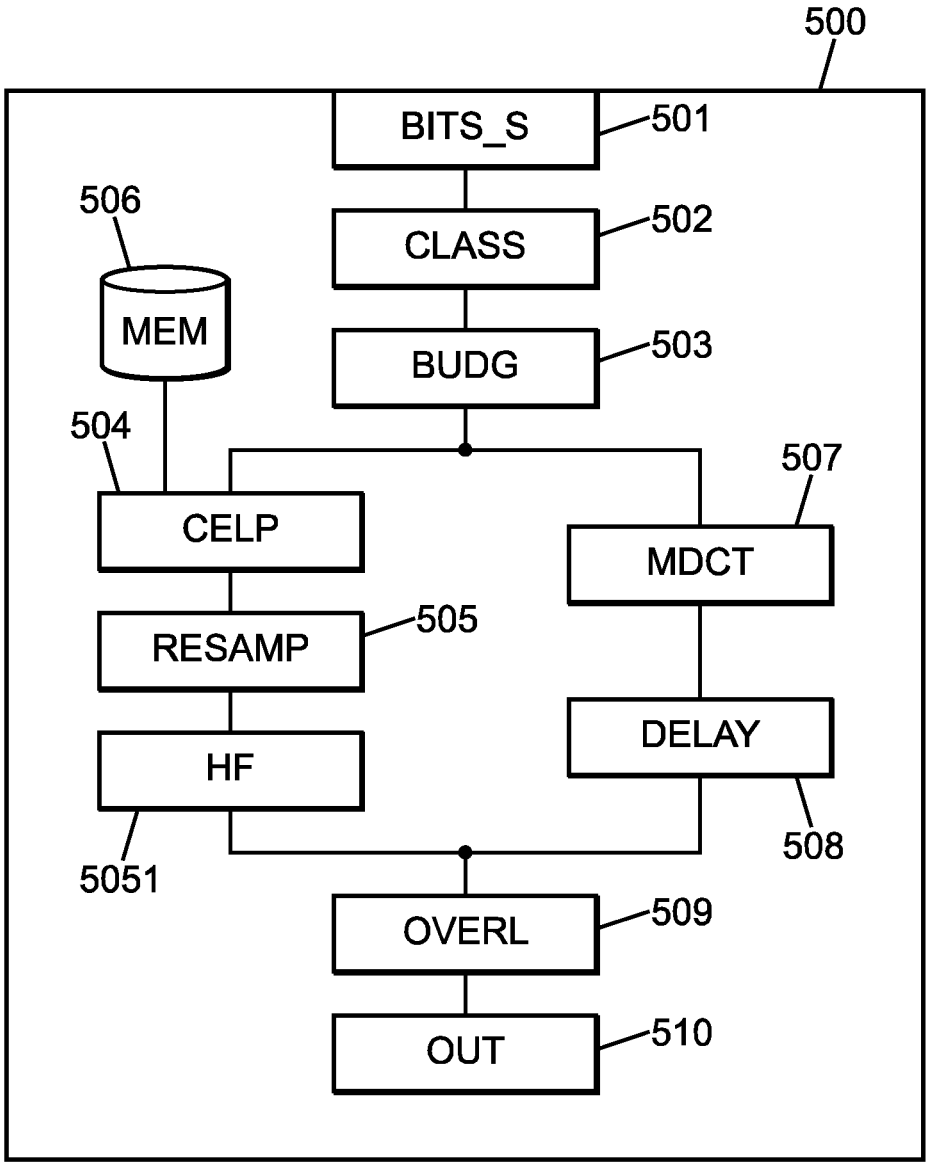
FIG. 5 illustrates an audio decoder according to an embodiment of the invention.
Figure 6:
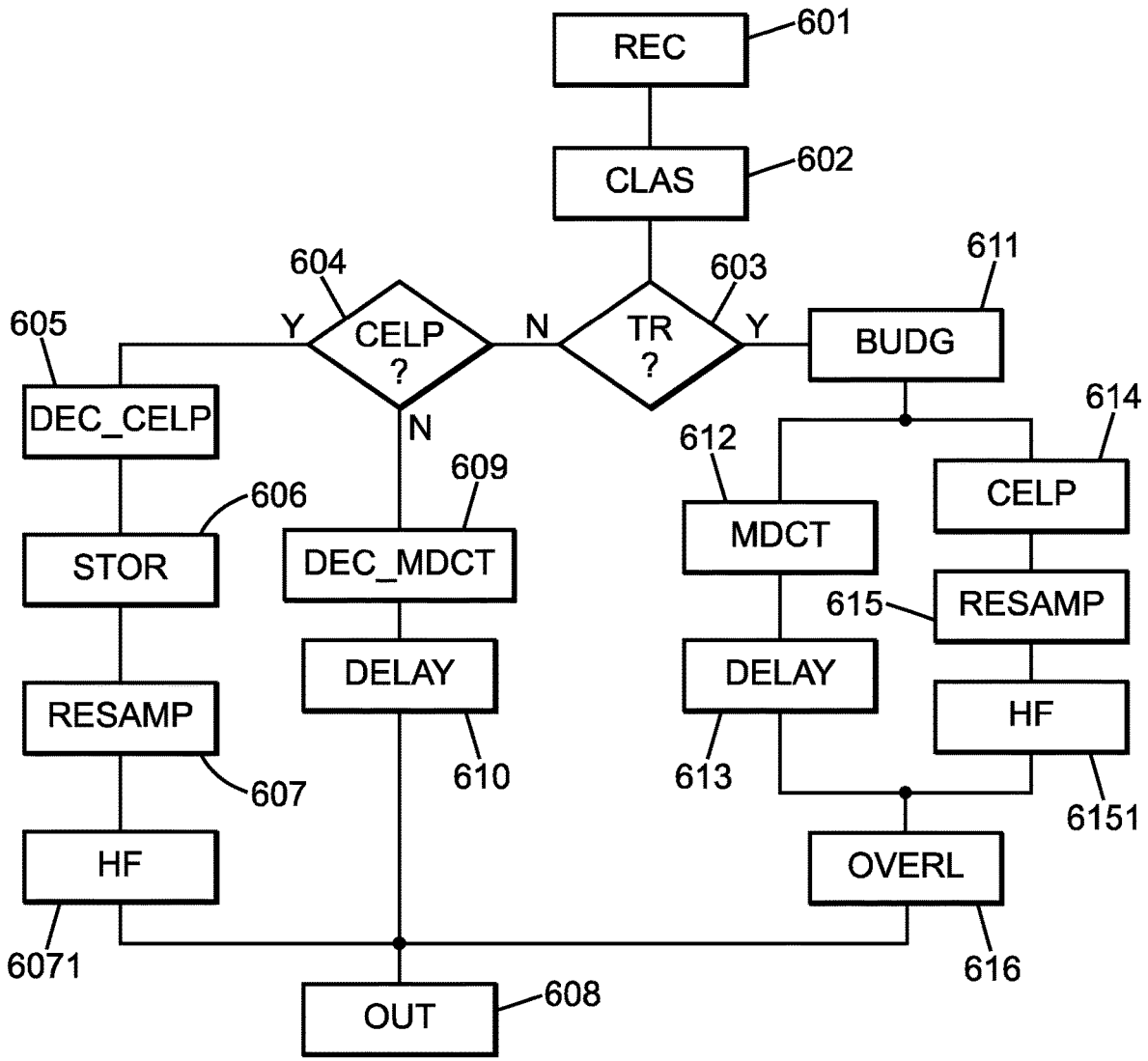
FIG. 6 is a diagram illustrating the steps of a method of decoding, implemented by the audio decoder of FIG. 5, according to an embodiment of the invention.

FIG. 5 illustrates an audio decoder 500 according to an embodiment of the invention and FIG. 6 is a diagram illustrating the steps of a method of decoding according to an embodiment of the invention, implemented in the audio decoder 500 of FIG. 5.

The decoder 500 comprises a receiving unit 501 for receiving, at step 601, the coded digital signal (or bit flow) originating from the coder 500 of FIG. 1. The bit flow is submitted to a categorising unit 502 able to determine, at step 602 if the current frame is a CELP frame, an MDCT frame, or a transition frame. For this purpose, the categorising units 502 is able to deduct a bit flow from the bit flow information indicating whether or not the current frame is a transition frame, and an information indicating which CELP core to use for decoding a CELP frame or a transition CELP sub-frame.

At step 603, it is verified that the current frame is a transition frame.

If the current frame is not a transition frame, it is verified at step 604 that the current frame is a CELP frame. If that is the case, the frame is transmitted to a CELP decoder 504 able to decode a CELP frame at step 605, with the core frequency indicated by the categorising units 502. After decoding a CELP frame, the CELP decoder 504 may store, at step 606, in a memory 506, parameters such as the linear prediction filter coefficients A(z) and internal states such as predictive energy in cases where the following frame is a transition frame.

As an output from the CELP decoder 504, the signal may be re-sampled, at step 607, with the output frequency of the decoder 500 by a re-sampling unit 505. In an embodiment of the invention, the re-sampling unit comprises an FIR filter and re-sampling introduces a delay of (for example) 1.25 ms. In an embodiment, post-processing may be applied to CELP decoding before or after re-sampling.

As mentioned above, in an embodiment, extending the band may also be performed, by a managing unit of band extension 5051 at steps 6071 and 6151, with decoding associated with the high band when the current frame is of CELP type. The high band is then combined to CELP coding with potentially an additional delay applied to the CELP synthesis at low band.

The signal decoded by the CELP decoder and re-sampled, potentially post-processed before or after re-sampling, is transmitted to an output interface 510 of the decoder at step 608.

The decoder 500 further comprises an MDCT decoder 507. In cases where has been determined at step 604 that the current frame is an MDCT frame, the MDCT decoder 507 is able to decode the MDCT frame in a classic manner at step 609. Furthermore, a delay corresponding to the delay necessary for the re-sampling application of the signal originating from the CELP decoder 504 is applied at the decoder output by a delay unit 508, so as to synchronise the MDCT synthesis with the CELP synthesis, at step 610. The signal decoded by MDCT and delayed is transmitted to the output interface 510 of the decoder at step 608.

In cases where the current frame is determined as being a transition frame after step 603, a device for determining the distribution of bits 503 is able to determine, at step 611, the first number of bits budg1 allocated for CELP coding the transition frame and the second number of bits budg3, allocated for transform coding the transition frame. The device 503 may correspond to the device 700 described in details in reference to FIG. 7.

The MDCT decoder 507 uses the third number of bits budg3 calculated by the determining unit 503 for adjusting the rate necessary for decoding the transition frame. The MDCT decoder 507 further zeroes the memory of the MDCT transformation and decodes the transition frame at step 612. The signal originating from the MDCT decoder is then delayed by the delay unit 508 at step 613.

In parallel, the CELP decoder 504 decodes the transition CELP sub-frame based on the first number of bits budg1, at step 614. For this purpose, the CELP decoder 504 decodes the CELP parameters that may depend on the current frame category, and comprising for example pitch values from the adaptive dictionary, the fixed and gains dictionary of the CELP sub-frame, and uses the linear prediction filter coefficients. Furthermore, the CELP decoder 504 updates the CELP decoding states. These states may typically comprise the predictive energy of the innovation originating from the preceding CELP frame for generating the signal sub-frame over 4 ms or 5 ms according to whether the 12.8 kHz or 16 kHz CELP core is being used (in the case of restricted coding the transition CELP sub-frame).

As previously mentioned, the application WO2012/085451 provides extra coding a sub-frame of 5 ms for the 12.8 kHz CELP core and two extra sub-frames of 4 ms for the 16 kHz CELP core.

As explained in reference to FIG. 3, in the 12.8 kHz case, the 6.25 ms delay is not filled and the overlap-add is affected: the decoder only has 0.625 ms of overlap-add, which is insufficient.

In the 16 kHz case, to extra CELP sub-frames are coded at the start of the transition frame, which only leaves very little budget for coding the transition MDCT frame and may lead to a quality decrease with respect to MDCT coding at "full rate" in the current frame.

Thus, the solution of the international application WO2012/085451 is not satisfying.

An independent aspect of the invention provides, from a single extra transition CELP sub-frame, partially generating a second sub-frame by reusing the coding parameters used for coding the transition CELP sub-frame. The delay is thus filled, by ensuring sufficient overlap-add, and without affecting the MDCT coding rate of the transition frame. For this purpose, the invention also aims for a method of decoding a coded digital signal P, in a decoder 500 able to decode the signal frames according to predictive decoding or according to transform decoding, comprising the following steps:

- receiving, at step 501, a first set of predictive coding parameters coding a first digital signal frame;
- predictive decoding, at step 605, the first frame based on the first set of predictive coding parameters;
- receiving, at step 501 for a new frame, a second set of parameters for predictive coding a first transition sub-frame of a transform coded transition frame,
- decoding, at step 614, the first transition sub-frame based on the second set of predictive coding parameters,
- generating, at step 614, samples from the second transition sub-frame, from at least one predictive coding parameter of the second set.

The invention further aims for the decoder 500 for implementing the method of decoding P, as well as a computer program comprising the instructions for performing the method of decoding P, when these instructions are executed by a processor.

The CELP parameters reused for generating the second sub-frame may be the gain vector, the adaptive dictionary vector, and the fixed dictionary vector.

According to an embodiment of the method of decoding P, a minimum overlap value may be predefined for transform decoding and the number of generated samples from the second sub-frame is determined based on the minimum overlap value. This last sub-frame may be generated without extra information by prolonging the CELP synthesis by repeating the pitch prediction with the same pitch delay and the same adaptive dictionary gain as in the first sub-frame, and by performing a synthesis LPC filtering with the same LPC coefficients and a de-emphasis or de-accentuation.

The second CELP sub-frame may then be truncated so as to only preserve 1.25 ms of signal in the case of the 12.8 kHz CELP core, and 2.25 ms of signal in the case of the 16 kHz CELP core. The first CELP sub-frame is thus completed so as to have 6.25 ms of extra signal allowing filling the gap and ensuring a satisfying overlap-add (minimum overlap value, for example of 1.875 ms) with the MDCT transition frame. In an embodiment, the extra CELP sub-frame has a length extended to 6.25 ms for the 12.8 and 16 kHz CELP cores, which implies modifying "normal" CELP coding for having such length of extended sub-frame, in particular for the fixed dictionary.

In addition to the previous embodiment of the method of decoding P, the method P may further comprise a step 615 of re-sampling performed by a finite impulse response filter. As previously explained, the FIR filter may be integrated into the re-sampling unit 505. Re-sampling uses the FIR filter memory from the preceding CELP frame and processing induces an extra delay of 1.25 ms in this example.

The method P may further involve a step of adding an additional signal obtained from samples stored in the finite impulse response filter memory, to fill the delay introduced by the re-sampling step. Thus, 1.25 ms of signal, in addition to the 6.25 ms of additional signal previously generated, are generated by the decoder 500, these samples advantageously allowing filling the delay introduced by the re-sampling of 6.25 ms of additional signal.

For this purpose, the FIR filter memory of the re-sampling unit 505 may be saved for each frame after CELP decoding. The number of samples in this memory corresponds to 1.25 ms at the CELP core frequency considered (12.8 or 16 kHz).

According to a complementary embodiment of the method P, re-sampling the stored samples is performed by an interpolation method introducing a second delay shorter than the first delay from the finite impulse response filter, which may be considered as null. Thus, the 1.25 ms of signal generated from the FIR filter memory, are re-sampled according to a method implying a minimum delay. For example, re-sampling the 1.25 ms of signals generated by the FIR filter memory may be performed by cubic interpolation, which implies a delay from two samples only, a minimum delay compared to the delay from the FIR filter. Thus, the two extra signal samples are required for re-sampling the above-mentioned 1.25 ms of signal: these two extra samples may be obtained by repeating the last value of re-sampling memory of the FIR filter.

The decoder may further decode the high-frequency part from the 6.25 ms of CELP signal obtained from the first and second transition frames. For this purpose, the CELP decoder 504 may use the adaptive gain and the fixed dictionary vector from the last sub-frame of the preceding CELP frame.

The decoder 500 further comprises an overlap-add unit 509 able to ensure the overlap-add, at a step 616, between the decoded and re-sampled CELP transition sub-frames, the samples re-sampled by cubic interpolation, and the decoded signal of the transition frame originating from the MDCT decoder 507.

For this purpose, the unit 509 applies the synthesis modified window 327 of FIG. 3. Thus, prior to the MDCT aliasing point for the two first quarters, the samples are zeroed. After the above-mentioned aliasing point, the windowed samples are divided by the non-modified window 324 of FIG. 3, and multiplied by a sinus-type window so that, combined with the window applied to the encoder, the total window is $\sin^2$. In the part concerned by the overlap-add, the samples originating from the CELP and 0-delay re-sampling (for example by cubic interpolation) are weighted by a $\cos^2$ window.

The transition frame thus obtained is transmitted to the output interface 510 of the decoder at step 608.

Figure 7:
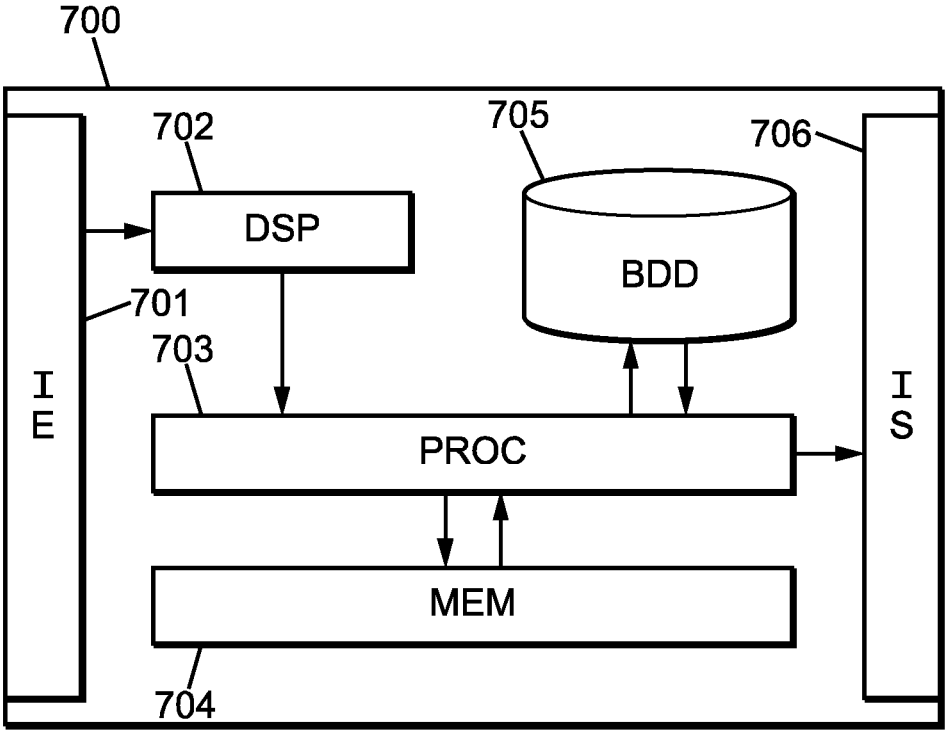
FIG. 7 illustrates the device for determining the distribution of bits in a transition frame according to an embodiment of the invention.

FIG. 7 represents an example of device 700 for determining the distribution of bits for a transition frame.

The device comprises a random access memory 704 and a processor 703 for storing instructions allowing implementing the method of determining the distribution of bits for a transition frame described above. The device also involves a mass memory 705 for storing data intended for being preserved after applying the method. The device 700 further involves an input interface 701 and an output interface 706 intended for receiving the digital signal frames and for emitting the detail for the budget allocated to these different frames, respectively.

The device 700 may further involve a digital signal processor (DSP) 702. This DSP 702 receives digital signal frames for forming, demodulating, and amplifying these frames, in a known manner known per se.

The present invention does not limit itself to the embodiments described above for example purposes; it extends to other variants.

Thus, an embodiment has been described wherein the compression or decompression devices are entities as a whole. Of course, the devices may be embedded in all types of more significant devices such as for example a digital camera, a photo camera, a mobile phone, a computer, a cinema projector, etc.

Moreover, an embodiment proposing a particular design of the compression, decompression, and comparison devices has been described. These designs are only given for illustrative purposes. Thus, an arrangement of the components and a different distribution of the tasks assigned for each of the components may also be considered. For example, the tasks performed by the digital signal processor (DSP) may also be performed by a classic processor.

The invention claimed is:

1. A method of coding a digital signal implemented in a coder able to code signal frames according to predictive coding or according to transform coding, comprising the following steps:

coding a preceding frame of digital signal samples according to predictive coding; and coding a current frame of digital signal samples in a transition frame: coding the transition frame comprising transform coding and predictive coding a single sub-frame of the transition frame, wherein said coding of the current frame comprises the following sub-steps:

determining a distribution of bits for coding the transition frame by the following operations:

assigning a bit rate for predictive coding of the transition sub-frame, said bit rate being equal to the minimum between the bit rate for transform coding the transition frame and a first predetermined bit rate value;

determining a first number of bits allocated for predictive coding the transition sub-frame for said bit rate; and calculating a second number of bits allocated for transform coding the transition frame from the first number of allocated bits and a number of bits available for coding the transition frame;

transform coding the transition frame on the second number of allocated bits; and predictive coding the transition sub-frame on the first number of allocated bits;

wherein the digital signal is decomposed into at least one frequency low band and one frequency high band, wherein the first calculated number of bits is assigned for predictive coding the transition sub-frame for the frequency low band, and wherein a third predetermined number of bits is allocated for coding the transition sub-frame for the frequency high band, wherein the second number of bits allocated for transform coding the transition frame is further determined from the third predetermined number of bits.

2. The method of coding according to claim 1, wherein predictive coding comprises generating determined predictive coding parameters for said allocated bit rate.

3. The method of coding according to claim 1, wherein predictive coding comprises generating predictive coding parameters restricted with respect to predictive coding the preceding frame by reusing at least one parameter for predictive coding of the preceding frame.

4. The method according to claim 1, wherein the coder/decoder comprises a first core operating, for predictive coding/decoding a signal frame, at a first frequency, and a second core operating, for predictive coding/decoding a signal frame, at a second frequency, wherein the first predetermined bit rate value depends on the core selected from the first and second cores for coding/decoding the predictive coded preceding frame.

5. The method according to claim 4, when the first core has been selected for coding/decoding the predictive coded preceding frame, the assigned bit rate is further equal to the maximum between the bit rate for the transform coded transition frame and at least one second predetermined bit rate value, the second value being lower than the first value.

6. A method of decoding a coded digital signal, implemented in a decoder able to decode signal frames according to predictive coding or according to transform decoding, comprising the steps of:

predictive decoding a preceding frame of digital signal samples coded according to predictive coding; and decoding a transition frame coding a current frame of digital signal samples, coding the transition frame comprising transform coding and predictive coding a single sub-frame of the transition frame, wherein said decoding of the current frame comprises the sub steps of:

determining a distribution of bits for decoding the transition frame by the following operations:

assigning a bit rate for predictive coding of the transition sub-frame, said bit rate being equal to the minimum between the bit rate for transform coding the transition frame and a first predetermined bit rate value;

determining a first number of bits allocated for predictive coding the transition sub-frame for said bit rate; and calculating a second number of bits allocated for transform coding the transition frame from the first number of allocated bits and a number of bits available for coding the transition frame;

predictive decoding the transition sub-frame on the first number of allocated bits; and transform decoding the transition frame on the second number of allocated bits, wherein the digital signal is decomposed into at least one frequency low band and one frequency high band, wherein the first calculated number of bits is assigned for predictive coding the transition sub-frame for the frequency low band, and wherein a third predetermined number of bits is allocated for coding the transition sub-frame for the frequency high band, wherein the second number of bits allocated for transform coding the transition frame is further determined from the third predetermined number of bits.

7. A non-transitory computer readable storage medium, with a program stored thereon, said program comprising instructions for implementing a method of determining the distribution of bits for coding a transition frame, said method being implemented in a coder/decoder for coding/decoding a digital signal, the transition frame being preceded by a predictive coded preceding frame, coding the transition frame comprising transform coding and predictive coding a single sub-frame of the transition frame, the method comprising the following steps:

assigning a bit rate for predictive coding of the transition sub-frame, said bit rate being equal to the minimum between the bit rate for transform coding the transition frame and a first predetermined bit rate value;

determining a first number of bits allocated for predictive coding the transition sub-frame for said bit rate; and calculating a second number of bits allocated for transform coding the transition frame from the first number of allocated bits and a number of bits available for coding the transition frame, when these instructions are executed by a processor, wherein the digital signal is decomposed into at least one frequency low band and one frequency high band, wherein the first calculated number of bits is assigned for predictive coding the transition sub-frame for the frequency low band, and wherein a third predetermined number of bits is allocated for coding the transition sub-frame for the frequency high band, wherein the second number of bits allocated for transform coding the transition frame is further determined from the third predetermined number of bits.

8. A coder able to code digital signal frames according to predictive coding or transform coding, comprising:

a device for determining a distribution of bits for coding a transition frame, the transition frame being preceded by a predictive coded preceding frame, coding the transition frame comprising transform coding and predictive coding a single sub-frame of the transition frame, the number of bits for coding the transition frame being fixed, the device comprising a processor arranged for performing the following operations:

assigning a bit rate for predictive coding the transition sub-frame, said bit rate being equal to the minimum between the bit rate for transform coding the transition frame and a first pre-determined bit rate value;

determining a first number of bits allocated for predictive coding the transition sub-frame for said bit rate;

calculating a second number of bits allocated for transform coding the transition frame from the number of bits required for coding the coding parameters and the fixed number of bits for coding the transition frame;

a predictive coder comprising a processor arranged for performing the following operations:

coding a preceding frame of digital signal samples according to predictive coding;

predictive coding a single sub-frame comprised in a transition frame coding a current frame of digital signal samples, coding the transition frame comprising transform coding and predictive coding said sub-frame, the processor being arranged for predictive coding the transition sub-frame on the first number of allocated bits; and a transform coder comprising a processor arranged for performing the operation of transform coding the transition frame on the second number of allocated bits, wherein the digital signal is decomposed into at least one frequency low band and one frequency high band, wherein the first calculated number of bits is assigned for predictive coding the transition sub-frame for the frequency low band, and wherein a third predetermined number of bits is allocated for coding the transition sub-frame for the frequency high band, wherein the second number of bits allocated for transform coding the transition frame is further determined from the third predetermined number of bits.

9. A decoder for a digital signal coded by predictive coding and by transform coding, comprising:

a device for determining a distribution of bits for coding a transition frame, the transition frame being preceded by a predictive coded preceding frame, coding the transition frame comprising transform coding and predictive coding a single sub-frame of the transition frame, the number of bits for coding the transition frame being fixed, the device comprising a processor arranged for performing the following operations:

assigning a bit rate for predictive coding the transition sub-frame, said bit rate being equal to the minimum between the bit rate for transform coding the transition frame and a first pre-determined bit rate value;

determining a first number of bits allocated for predictive coding the transition sub-frame for said bit rate;

calculating a second number of bits allocated for transform coding the transition frame from the number of bits required for coding the coding parameters and the fixed number of bits for coding the transition frame;

a predictive decoder comprising a processor arranged for performing the following operations:

predictive decoding a preceding frame of digital signal samples coded according to predictive coding;

predictive decoding a single sub-frame comprised in a transition frame coding a current frame of digital signal samples, coding the transition frame comprising transform coding and predictive coding said sub-frame, the processor being arranged for performing the operation of predictive decoding the transition sub-frame on the first number of allocated bits; and a transform decoder comprising a processor arranged for performing the operation of transform decoding the transition frame on the second number of allocated bits, wherein the digital signal is decomposed into at least one frequency low band and one frequency high band, wherein the first calculated number of bits is assigned for predictive coding the transition sub-frame for the frequency low band, and wherein a third predetermined number of bits is allocated for coding the transition sub-frame for the frequency high band, wherein the second number of bits allocated for transform coding the transition frame is further determined from the third predetermined number of bits.

10. The method according to claim 9, wherein the number of bits available for coding the transition frame is fixed.

11. The method according to claim 10, wherein the second number of bits is equal to the fixed number of bits for coding the transition frame minus the first number of bits minus as the third number of bits.

12. The method according to claim 10, wherein the second number of bits is equal to the fixed number of bits for coding the transition frame minus the first number of bits minus the third number of bits minus a first bit minus a second bit, the first bit indicating whether low-pass filtering is performed when determining the predictive coding parameters of the transition sub-frame, said parameters being related to the tonal lead time, the second bit indicating the frequency used by the coder/decoder core for predictive coding/decoding the transition sub-frame.

* * * * *